US007670026B1

(12) United States Patent
Hawkins

(10) Patent No.: US 7,670,026 B1
(45) Date of Patent: Mar. 2, 2010

(54) NIGHT-LIGHT RUG

(76) Inventor: Victor Jonathan Hawkins, 2021 Lago Grande Cir., Fort Mohave, AZ (US) 86426

( * ) Notice: Subject to any disclaimer, the term of this patent is extended or adjusted under 35 U.S.C. 154(b) by 0 days.

(21) Appl. No.: 12/290,360

(22) Filed: Oct. 29, 2008

(51) Int. Cl.
*F21V 33/00* (2006.01)

(52) U.S. Cl. ..... 362/249.05; 362/153; 362/253; 362/249.02; 362/249.13

(58) Field of Classification Search ..... 362/153, 362/153.1, 253, 234, 249.12, 249.13, 249.02, 362/249.05
See application file for complete search history.

(56) References Cited

U.S. PATENT DOCUMENTS 4,544,993 A * 10/1985 Kirk ..... 362/153
4,737,764 A * 4/1988 Harrison ..... 362/153
4,794,373 A * 12/1988 Harrison ..... 340/286.01
5,019,950 A * 5/1991 Johnson ..... 362/130
5,848,830 A * 12/1998 Castle et al. ..... 362/84
6,481,877 B1 * 11/2002 Bello, Jr. ..... 362/488
6,718,576 B1 * 4/2004 Shih ..... 5/417
2007/0258255 A1 * 11/2007 Kessler et al. ..... 362/487

* cited by examiner

*Primary Examiner*—Laura Tso
(74) *Attorney, Agent, or Firm*—Risto A. Rinne, Jr.

(57) ABSTRACT

An apparatus for providing illumination includes a lower light panel that contains at least one battery and electronic control circuitry therein. A plurality of LEDS are each disposed in a corresponding plurality of recesses in the light panel. A reflective coating is preferably included in each of the recesses. A clear plastic sheet is disposed over an upper surface of the light panel. A rug is disposed over the light panel and is detachably-attached thereto. When a person steps on the rug one or more of a plurality of pressure activated switches are energized which, in turn, activates the circuitry and energizes the LEDS. The LEDS are illuminated for a first predetermined period of time that is selectable. When the first timer elapses the lights and circuitry turn off and the apparatus returns to a quiescent state until the cycle is repeated. The rug is removed from the light panel for cleaning of the rug and the plastic sheet is also removed for servicing of the light panel.

19 Claims, 3 Drawing Sheets

NIGHT-LIGHT RUG

BACKGROUND OF THE INVENTION

1. Field of the Invention

The present invention, in general, relates to throw rugs and mats and, more particularly, to illuminated throw rugs and mats.

The instant invention is for use with mats or rugs. A definition of a mat as found in "dictionary.com" is, "a protective covering on a floor or other surface" that is made of a pliant material. Another definition of a mat from the same location is, "A flat piece of coarse fabric or other material used for wiping one's shoes or feet, or in various other forms as a floor covering." Webster's New World College Dictionary also includes as a definition of a mat a, "removable floor covering for a car."

A definition of a rug as found in "dictionary.com" is, "a thick fabric for covering part of a floor, often woven of wool and often having an oblong shape with a border design." A definition of a scatter rug as found in "dictionary.com" is a small rug for covering a part of a floor. Also called throw rug."

Accordingly, there is considerable overlap of these terms and they may, at times, be used interchangeably to describe the same general apparatus. Generally, a mat is commonly intended for usage in a variety of specific locations, such as by a door (for a doormat) or in a bathroom (for a bathmat). A mat can be formed from a variety of materials and may include a variety of sizes shapes and thicknesses.

Generally, a throw rug or scatter rug is similar to a rug but is usually smaller in size than a rug. However, there does not appear to be any clearly defined delineation in size between the two. A throw rug or scatter rug can also be formed from a variety of materials as well and it, too, may include a variety of sizes shapes and thicknesses.

Usually, when coarser fibers such as hemp or cocoa fiber are used it is referred to as a mat. If the apparatus is formed of rubber only, it is also usually referred to as a mat. If an upper layer of a coarse type of fiber is embedded in a rubber base layer, it is usually referred to as a mat and in particular as a doormat. Such a doormat is intended to provide a surface upon which one may wipe and thereby clean their shoes, usually before entering a building. If an upper layer of a softer or woven type of fiber is embedded in a rubber base it may be referred to as a mat or as a throw (or scatter) rug.

For the following description, the word "rug" is used and is intended to include any type of rug, throw rug, scatter rug, or any type of mat, any of which being formed of any preferred material and including any desired size, shape, or thickness. By expanding the term "rug" to include all types of mats as well as all types of rugs, throw rugs, and scatter rugs, the disclosure of the invention is improved by avoiding the need for a redundancy of explanation so as to provide clarity with optimum brevity.

Many people prefer to sleep in the dark. When they awaken during the night and desire to move away from the bed the darkness is an impediment. If they cannot see they may become disoriented in the dark and impact objects. They may fall or otherwise injure themselves as well as damage objects.

A conventional type of a night-light is not a viable option because it interferes with their ability to sleep.

Conventional lighting, whether a table lamp or an overhead ceiling light, requires activation and it can be difficult to search in the dark and locate a switch of the table lamp or walk across the room and grope for the location of a wall switch to activate a ceiling light, for example.

While a limited variety of illuminated rugs are known, they have various problems that are inherent with their designs. For example, certain prior art devices include a central light source with fiber optic elements that radiate and protrude upward through the surface of the rug. This type of a design poses a risk of a user being cut by the fine fiber optic filaments that protrude. The feet are certainly at risk as would be any part of the anatomy that came in contact with such filaments. For example, a baby that was crawling on such a device would be at risk of puncturing the skin at any contact point including the face and eyes.

Additionally, there is little dispersion of light that occurs after the light has left the fiber optic filaments. Therefore, in order to see the light one must be disposed in a position that generally is directly above the mat in order to see any appreciable light. This type of a design is largely ineffective at illuminating a larger area for practical purposes and is seen as a low durability novelty type of device.

Certain other prior art devices include an on-off switch that must be located and which can draw power and remain illuminated when it is not needed. It may also be difficult to locate the on-off switch in the dark.

Certain other prior art devices include a transformer and are connected to a 120 VAC source of electrical power. Accordingly, they require an electrical wire from the transformed to the device that can pose a tripping hazard. Additionally, the need for a 120 VAC outlet limits placement of such a device.

Similarly, prior art devices that use motion sensors must maintain power to the motion sensor which would prematurely drain any battery. Accordingly, if a motion sensor is used the device must be connected to a 120 VAC source of power.

A prior art device, as offered for sale in a 2008 Hammacher Schlemmer Holiday Preview catalog on page 49 uses wireless activation of remote lights when a person stands on an elevated foot mat. Such a design is difficult to activate and it provides a narrowly directed field of illumination that is not generally useful. It is also especially high and can pose a tripping hazard. Therefore, it is not well-suited for placement on a floor in a center of a room and is better suited for placement against a wall, bed, or other object. It also detracts from the room's aesthetics and is not interesting or amusing. Accordingly, it has appeal to only a limited number of users such as by senior citizens and is generally lacking in appeal to more youthful buyers. It does not provide any joy or resonate with any interest of the user. Additionally, it is not suitable for use outside, such as a doormat.

There is a need for a device that is self-contained and which runs, preferably, on batteries. There is a need for a device that conserves battery power by remaining off until it is stepped on and which remains illuminated for a predetermined period of time after being stepped on or which remains illuminated until it is stepped on for a second time.

There is a need for a device that provides illumination and which is attractive in appearance or which can be used to provide an ornamental design that accents an area or which resonates with an interest or hobby of a user.

Additionally, there is a need for a device that does not include any protruding lights or other protruding source of illumination that can be impacted by a user or which might cause harm or injury if contacted.

There is a need for a device that can provide illumination where desired, for example, by a bed, bathroom, in the hall, or by an interior or exterior door.

Other needs include by a toilet, in boats and recreational vehicles (RVs), camping, outdoor recreational activities, seasonal uses, for holidays, those that correspond with a specific sport or team, and as utility mats (devices) that are used in garages, workshops, sheds, basements, the top and bottom of stairs, etc. to provide ready and instant illumination upon the approach of a person or, stated in other words, exactly when needed.

There is also a need for a placement of illumination that supports a theme of the device, for example, if an object is shown on the device the placement of a plurality of sources of illumination (i.e., lights) that ideally enhance the visual appearance of the object is especially desired.

There is also a need for a placement of illumination that supports a character theme, such as DISNEY™ characters, comic book characters, or characters, whether fictitious or real, of movies.

There is also a need to ensure that a rug portion of such a device is detachable for cleaning and to facilitate access to the illuminated portion of the device for any required maintenance, such as replacing batteries, varying timer settings, or replacing lights, etc.

There is also a need for a device that can be used during travel, for example, to provide illumination when waking during the night in an unfamiliar room.

There is also a need for a device that provides illumination without the effort of having to search for a wall or appliance switch.

Accordingly, there exists today a need for a night-light rug that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

Clearly, such an apparatus would be a useful and desirable device.

2. Description of Prior Art

Illuminated devices are, in general, known. For example, the following patents describe various types of these devices, some of which may have relevance as well as others which may not have particular relevance to the invention. These patents are cited not as an admission of their having any particular relevance to the invention but rather to present a broad understanding of the current state of the art appertaining to either the field of the invention or possibly to other related or distal fields of invention.

U.S. Pat. No. 7,358,861 to Blum et al., that issued on Apr. 15, 2008;

U.S. Pat. No. 6,718,576 to Shih, that issued on Apr. 13, 2004;

U.S. Pat. No. 5,848,830 to Castle et al., that issued on Dec. 15, 1998;

U.S. Pat. No. 5,019,950 to Johnson, that issued on May 28, 1991;

U.S. Pat. No. 4,737,764 to Harrison, that issued on Apr. 12, 1988;

U.S. Pat. No. 4,544,993 to Kirk, that issued on Oct. 1, 1985; and including,

U.S. Patent Publication No. 2007/0258255 that published on Nov. 8, 2007.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a night-light rug that extends battery life because it does not draw electrical power when it is not providing illumination.

It is also an important object of the invention to provide a night-light rug that turns on when it is stepped on and off after a period of time.

Another object of the invention is to provide a night-light rug that runs on batteries.

Still another object of the invention is to provide a night-light rug that includes a lower light panel for housing a plurality of lights, batteries, control circuitry, and pressure sensitive switches and a rug that is disposed over and secured to the light panel through which light is emitted when the light panel is activated.

Still yet another object of the invention is to provide a night-light rug that includes a lower light panel for housing a plurality of lights, batteries, control circuitry, and pressure sensitive switches and a clear plastic coating to protect the components of the light panel.

Yet another important object of the invention is to provide a night-light rug that a lower light panel for housing a plurality of lights, batteries, control circuitry, and pressure sensitive switches and wherein each of the plurality of lights is disposed in a recessed area and where a reflective coating is preferably placed in each of the recessed areas to increase light emanation.

Still yet another important object of the invention is to provide a night-light rug that uses a plurality of LED lights and, when desired, white LED lights.

A first continuing object of the invention is to provide a night-light rug that includes a lower light panel for housing a plurality of lights, batteries, control circuitry, and pressure sensitive switches and a rug that is disposed over and secured to the light panel through which light is emitted when the light panel is activated, and wherein an ornamental design is included in the rug, and wherein means are included that align the rug with the light panel so as to dispose the plurality of lights at predetermined locations below the ornamental design so as to add to the appearance of the ornamental design.

A second continuing object of the invention is to provide a night-light rug that includes a lower light panel and a detachable rug, wherein the rug can be detached from the light panel for cleaning or washing and to permit access to the light panel for maintenance or servicing thereof.

A third continuing object of the invention is to provide a night-light rug that can include any preferred overall shape, such as that of a football or other object, and which can include any preferred size.

Briefly, a night-light rug that is constructed in accordance with the principles of the present invention has a lower light panel that includes a planar sheet of material, such as a ⅝ of an inch thick sheet of foam. A plurality of recesses and preferably hemispherical recesses are provided in an upper surface of the light panel along with a recessed groove that extends from a battery (or batteries) and control circuitry to a plurality of pressure activated switches, and to each of a plurality of lights. A reflective coating is preferably included in each of the recesses. A clear plastic sheet is disposed over the upper surface of the light panel. A rug is disposed over the light panel and is detachably-attached thereto. When a person steps on the rug one or more of the pressure activated switches are energized which, in turn, supplies electrical energy from the battery to the circuitry and also to the lights which begins the countdown of a first timer. The lights are illuminated for a first predetermined period of time that is equal to the duration of the timer. The first predetermined period of time, and therefore the duration of the first timer, is selectable. When the first timer elapses the lights and circuitry turn off and are no longer energized until the cycle is repeated. If desired, the lights and circuitry can be set to turn off if the rug is stepped on for a second time within a second predetermined period of time. A second timer monitors the second predetermined period of time which, preferably, is also selectable. The rug is removed from the light panel for servicing of the light panel and for cleaning of the rug.

DETAILED DESCRIPTION OF THE INVENTION

Figure 1:
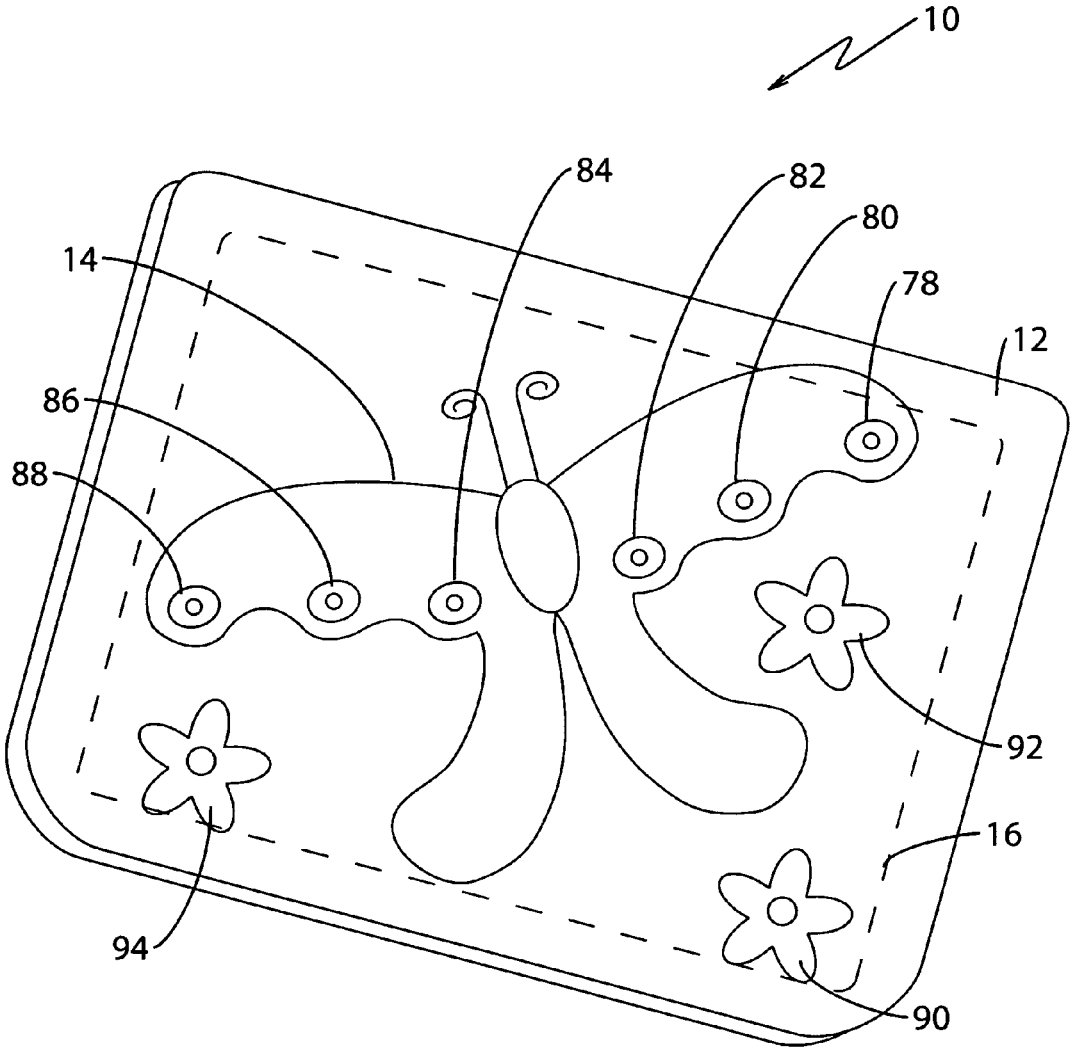
FIG. 1 is a view in perspective of a night-light rug.

Referring to FIG. 1 initially and as necessary to all of the drawing figures is shown, a night-light rug, identified in general by the reference numeral 10.

The night-light rug 10 includes a flexible rug 12 as an uppermost surface when it is assembled. The rug 12 can include any preferred material or type of construction providing that the rug 12 is able to allow at least some of the light coming from an illumination source (as is described in greater detail hereinafter) that is disposed under the rug 12 to pass through the rug 12.

If desired, the rug 12 includes an ornamental design 14, here shown as a butterfly.

Figure 2:
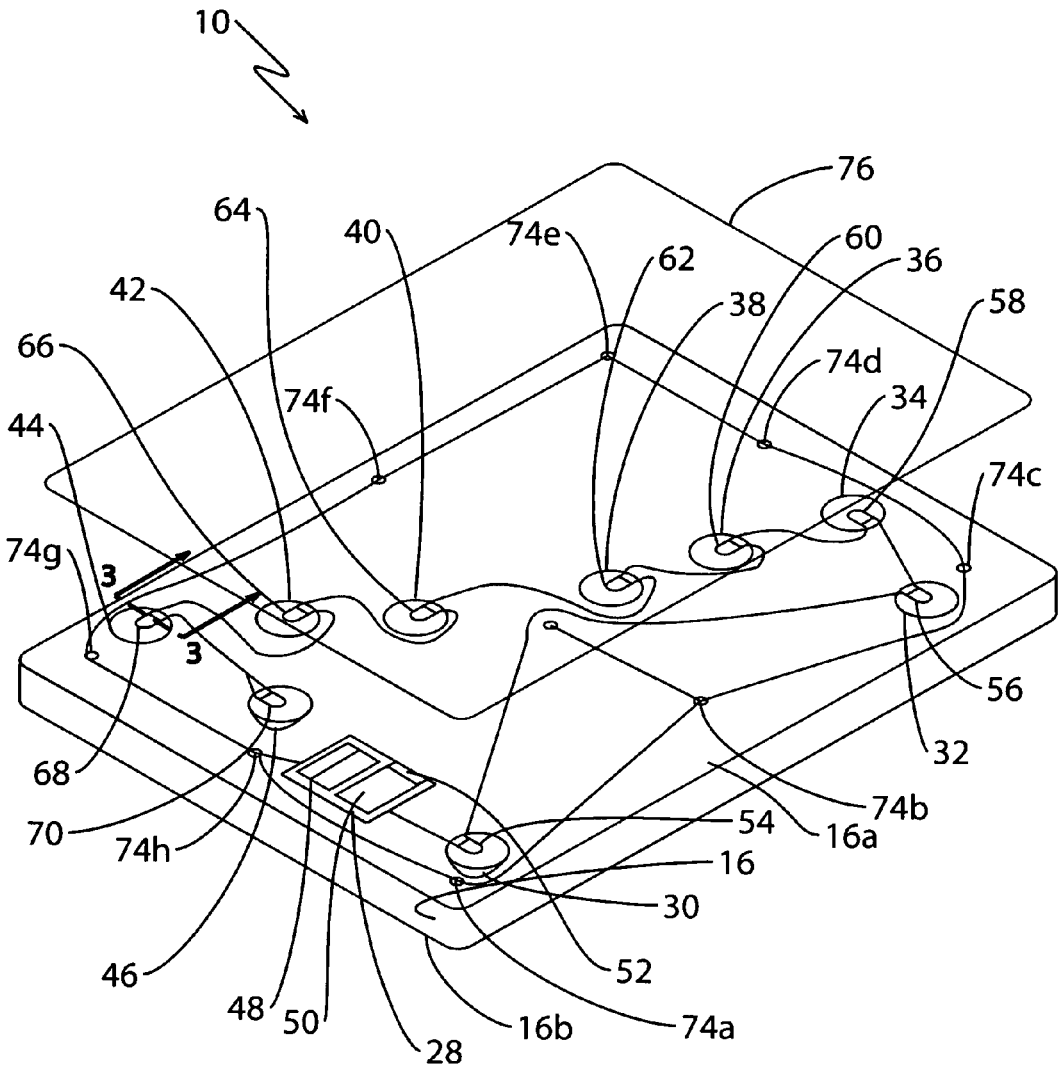
FIG. 2 is a view in perspective of a light panel of the night-light rug of FIG. 1 and which also shows in exploded view, a clear plastic sheet disposed above the light panel.
Figure 4:
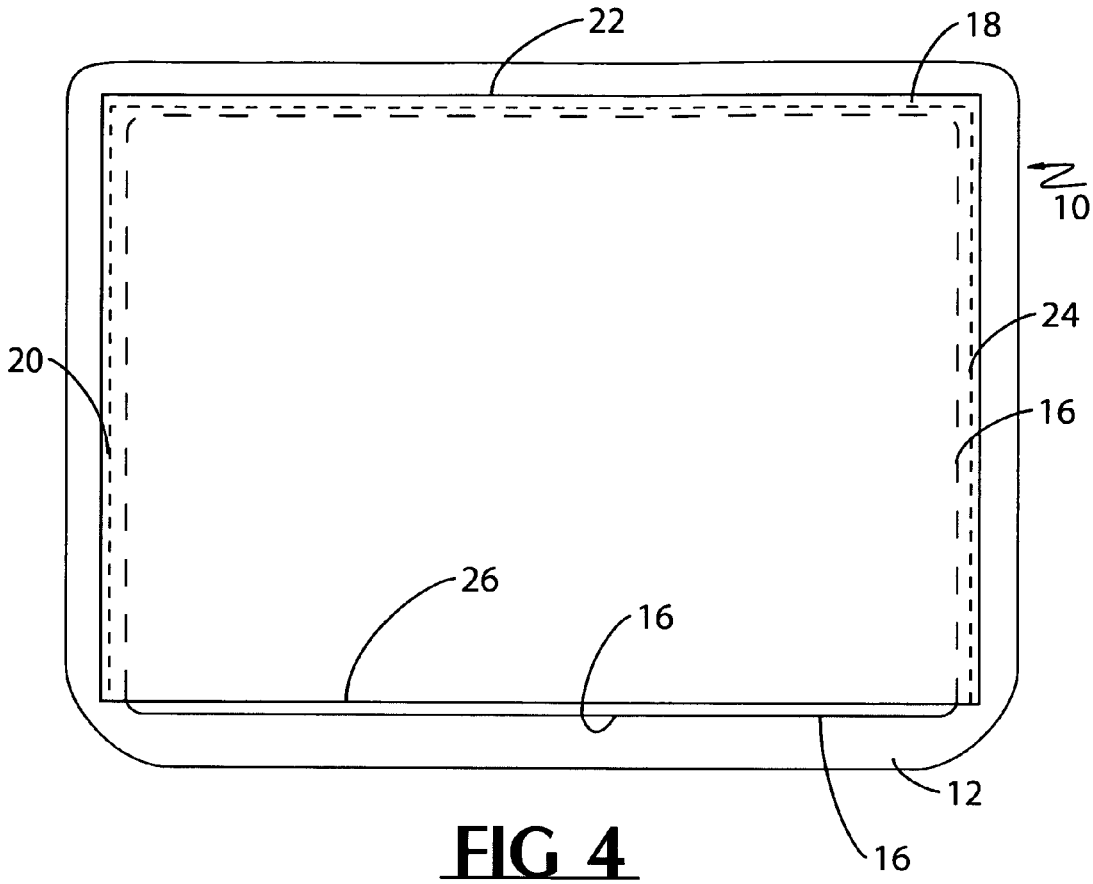
FIG. 4 is a bottom plan view of the night-light rug of FIG. 1.

Referring also to FIG. 2 and to FIG. 4, a light panel 16 is disposed under the rug 12. The light panel 16 is shown in dashed lines in FIG. 1 and FIG. 4. A fabric 18 is sewn to an underside of the rug 12 at a first side 20, a second side 22, and at a third side 24 but which is open at a fourth side 26 provides a pouch into which the light panel 16 can be placed or removed. A tight fit is provided between the light panel 16 and the interior of the pouch which ensures good alignment between the light panel 16 and the rug 12.

A tight fit helps to facilitate enhanced viewing of the ornamental design 14, as is described in greater detail hereinafter. It also ensures that the rug 12 will remain affixed to the light panel 16 during use. This prevents the rug 12 from slipping off of the light panel 16 which avoids the possibility of a fall by a user. Also, because the light panel 16 can be readily detached from the rug 12, the rug 12 can be cleaned or washed, as desired. Additionally, the light panel 16 is exposed for maintenance or repair-related access.

The light panel 16 is formed of a predetermined size and shape of generally planar material that preferably has some give to it. Accordingly, Styrofoam or other types of foam are preferred. A preferred thickness for the light panel is approximately five-eights of an inch thick, also thicker or thinner versions are possible.

A plurality of recesses are provided in the light panel 16 that are each open to an upper surface 16*a* of the light panel 16 and which are closed to an opposite, lower surface 16*b* thereof. These recesses include a first recess 28, a second recess 30, a third recess 32, a fourth recess 34, a fifth recess 36, a sixth recess 38, a seventh recess 40, an eighth recess 42, a ninth recess 44, and a tenth recess 46.

The first recess 28 includes space for batteries 48 and electronics 50. One or more of the batteries 48 may be used and any type although a type of the batteries 48 that is commonly known as having an AAA size is preferred because of its thinness and economy. The light panel 16 includes a useful life of up to a year with typical usage if powered by AAA types of the batteries 48.

The electronics 50 include control circuitry (analog, digital, or a mixture thereof including a microcomputer, if desired), a first timer and other component parts as may be desired. Integrated circuit timers and microcomputers are known in the electronic arts as is the basic circuitry also known or knowable to operate the night-light rug 10, as described herein. Accordingly, any electrical engineer skilled in the arts could either find or design and thereby provide such circuitry as could any engineer skilled in the programming arts provide the programming necessary to operate the microcomputer. The electronics 50 also preferably includes a switch input 52 for varying the duration of the first timer.

The second recess 30 through the tenth recess 46 each includes a hemispherical shape. The second recess 30 includes a first LED 54 disposed therein. The third recess 32 through the tenth recess 46 each include a second LED 56 through a ninth LED 70, respectively. Each LED 54-70 is preferably a bright white LED and is preferably, but not necessarily, disposed in a horizontal attitude.

It is important that each of the LEDS is contained fully within the volume as provided by the hemispherical shape of the second recess 30 through the tenth recess 46 in order to prevent the possibility of them being stepped on and damaged or of their possibly contacting a foot or an exposed body part of a user and possibly causing injury or irritation to the user.

Figure 3:
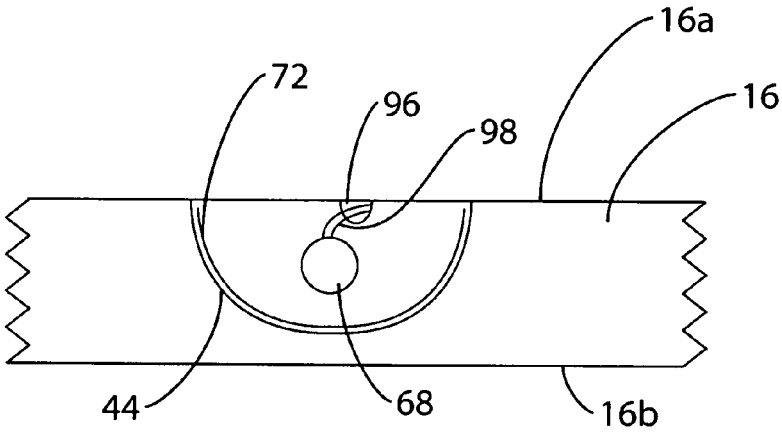
FIG. 3 is a cross sectional view taken on the line 3-3 in FIG. 1.

Referring now momentarily to FIG. 3, the ninth recess 44 is shown as including a reflective coating 72 that is applied to the ninth recess 44. The reflective coating 72 preferably includes a flexible, bright, inexpensive and reflective material, such as aluminum foil, that is placed therein and which is used to reflect more of the light that is produced by the eighth LED 68 upward and out of the light panel 16. The second recess 30 through the tenth recess 46 each preferably include the reflective coating 72.

Any preferred type or number of pressure activated switches 74*a*-74*h* are included with the light panel 16. A minimum of one is required. Typically, the pressure activated switches 74*a*-74*h* are a type of normally open switch that are electrically wired in parallel and therefore, when one or more are closed, a circuit is completed that supplies electrical power to the electronics 50 from the batteries 48.

It is also possible to use other means for activating the night-light rug 10 (i.e., to turn it on) other than the pressure activated switches 74*a*-74*h*. For example, one or more sensors that detect a change in movement can be used if desired to detect changes in inertia or any acceleration that may occur to the night-light rug 10 if it is shoved, kicked, or otherwise moved from a rest position. Alternately, any type of a motion sensor that detects the approach of another person could also be used. However, in order to maximally extend the useful life of the batteries 48, it is desirable that the pressure activated switches 74*a*-74*h* or any other type of sensor that is used draw no energy (or a minimal amount of energy) from the batteries when the night-light rug 10 is in a quiescent (off) state.

The pressure activated switches 74*a*-74*h* are placed where desired on the light panel 16. The goal is to ensure that at least one of the pressure activated switches 74*a*-74*h* will be activated (i.e., electrically closed) when a user steps anywhere on that portion of the rug 12 that is disposed over the light panel 16.

If desired, the pressure activated switches 74*a*-74*h* can each include and be placed in a corresponding switch recess. Each switch recess provides an anchor to properly orient each of the pressure activated switches 74*a*-74*h* and also to maintain each of the pressure activated switches 74*a*-74*h* so that an upper and activating portion of each of the pressure activated switches 74*a*-74*h* is disposed above the plane of the upper surface 16*a* of the light panel 16.

A clear plastic sheet 76 (shown elevated above the light panel 16 in FIG. 2) is placed over the upper surface 16*a* of the light panel 16. Accordingly, when a user steps on the rug 12, which is disposed over the plastic sheet 76, the user's weight is distributed through the rug 12 to the plastic sheet 76 which, in turn, depresses and electrically closes one or more of the pressure activated switches 74*a*-74*h*, because the upper and activating portion of each of the pressure activated switches 74*a*-74*h* is disposed above the plane of the upper surface 16*a* of the light panel 16.

When electrical power is supplied to the electronics 50, a first timer is activated that begins a countdown of a first predetermined period of time. This time can be one, two, three, four or more minutes in duration. The switch input 52 is used to select and thereby determine a preferred magnitude for the first timer. This can vary, depending on the intended use of the night-light rug 10 as well as personal preferences.

If, for example, a child is using the night-light rug 10 as a bed-side mat for illumination when the child wakes and needs to use the bathroom, the child may prefer a short duration for the first timer such as a minute or two if the child is quick to return. However, an elderly or more infirm person may, for the same purpose, require a greater duration of time to accomplish a similar type of bathroom excursion.

In order to change the batteries 48, replace any of the LEDS 54-70, or adjust the first timer, which is done by varying any of a plurality of input switches that are included as part of the switch input 52, the user removes the light panel 16 from the pouch provided in the rug 12 and then removes the plastic sheet 76. This exposes all of the component parts of the night-light rug 10 for service or adjustment. It also permits cleaning or washing of the rug 12. After servicing the sequence is reversed to restore the night-light rug 10 to use.

When electrical power is supplied to the electronics 50, the electronics 50 activate all of the LEDS 54-70 which all turn on and produce light. At least some of the light passes through the rug 12 and is visible, especially when it is dark. Enough light is visible so as to provide illumination of the area in which the night-light rug 10 is disposed.

Referring alternately between FIG. 1 and FIG. 2, it can be observed that the position of the third LED 58 through the eighth LED 68 each align with a corresponding decorative spot 78-88, respectively, of the ornamental design 14 and that the first LED 54, the second LED 56, and the tenth LED 70 each align with a corresponding decorative flower 90-94 of the ornamental design 14.

Once electrical power is supplied to the electronics 50, the electronics 50 activate an electronic switch (such as a relay or transistor, etc.) that is included as a part of the electronics 50. The electronic switch functions as a latch to maintain electrical power to the electronics 50 until the first timer counts down to zero and elapses. When the first timer counts down to zero the electronic switch is released. This will cause all of the LEDS 54-70 to turn off and return the night-light rug 10 to the quiescent state. The quiescent state is the normal state that the night-light rug 10 is in for the greater majority of time. In the quiescent state the LEDS 54-70 are off and no electrical power is being consumed from the batteries 48.

If the user steps on the night-light rug 10 and activates any of the pressure activated switches 74*a*-74*h* while the first timer is performing its countdown to zero, the reactivation is ignored according to a first, preferred embodiment. The first timer continues to count down from the time when it was first enabled (i.e., activated).

This permits the user to step on the night-light rug 10, activate the first timer, and illuminate the LEDS 54-70 while the bathroom break is being accomplished. The user can then return to bed perhaps once again stepping on the night-light rug 10 but without affecting the remaining time until the first timer reaches zero. This ensures that all of the LEDS 54-70 will go off shortly after the user returns to bed.

Each of the LEDS 54-70, the pressure activated switches 74*a*-74*h*, and the batteries 48 and electronics 50 are connected by wiring. As previously described, the pressure activated switches 74*a*-74*h* are connected in parallel and an output thereof is connected by electrical wire to the electronics 50. Similarly, the LEDS 54-70 are wired together (either in parallel with current limiting means or in series with current limiting means) and are connected to an output of the electronics 50.

Referring briefly again to FIG. 3, is shown a wire groove 96 that is provided in the upper surface 16*a* of the light panel 16. The wire groove 96 is used where desired to provide a convenient conduit for placing any of the electrical wires, as represented by reference numeral 98, therein that extend between any of the component parts of the light panel 16.

If desired, operation of the night-light rug 10 is varied slightly according to a second embodiment. According to the second embodiment a second countdown timer that counts down for a second predetermined period of time is also included. The second countdown timer begins its countdown at the same time (i.e., upon initial activation) that the first timer begins its countdown. The duration of the second timer (i.e., the second predetermined period of time) is less than the first predetermined period of time and would typically be from about ten to thirty seconds in duration.

According to the second embodiment, the first countdown timer continues to operate as previously described and to ignore any repeated activation (i.e., closure) of any of the pressure activated switches 74*a*-74*h* that occurs during countdown of the second timer. This provides enough time for the user to activate the night-light rug 10 and wander away. If there are no further activations (i.e., closures) of any of the pressure activated switches 74*a*-74*h* that occur after the second timer has elapsed and before the elapse of the first timer, the LEDS 54-70 will be turned off and the night-light rug 10 returned again to the quiescent state as soon as the first timer has elapsed (i.e., finished its countdown to zero).

However, if a subsequent activation of any of the pressure activated switches 74*a*-74*h* occurs after the second timer has elapsed and prior to elapse of the first timer, the subsequent activation is used to immediately turn of the LEDS 54-70. In this manner the user can step on the night-light rug 12 and turn on the LEDS 54-70. When the user returns, for example to bed after a bathroom break and again steps on the night-light rug 10, the LEDS 54-70 turn off. This restores darkness as soon as illumination from the night-light rug 10 is no longer needed. If, however, the user returns and fails to again step on the night-light rug 10 when returning to bed, the LEDS 54-70 will turn off as soon as the first timer elapses. This will restore darkness after the first predetermined period of time has elapsed.

The plastic sheet 76 provides many benefits besides providing a surface that the user can depress to activate any of the pressure activated switches 74*a*-74*h*. For example, the plastic sheet 76 provides a protective covering over the component parts of the light panel 16 that prevent dirt and other contaminants from entering and causing damage. It also provides a smooth surface under the rug 12 that is comfortable for the user to step on. The plastic sheet 76 also helps protect the components from exposure to water and allows use of the night-light rug 10 outside. Additionally, the plastic sheet 76 can be easily replaced if it becomes damaged or worn.

Other changes are possible to those having had benefit from the instant disclosure. For example, any number, type, or color of LEDS 54-70 can be used. Similarly, their placement can be varied to provide any desired effect. Of course, the first and second timers can be configured to count upward instead of downward and accomplish the same functionality.

Similarly, the capacity of the batteries 48 can be varied depending on the number of LEDS 54-70 that are used as well as the intended use of the night-light rug 10. For some applications a greater or lesser anticipated life for the batteries 48 is preferred. The material used for the light panel 16 or the rug 12 can be varied to suit.

The overall size (i.e., area) of the night-light rug 10 is also a design variable. The thickness of the light panel 16 can also be varied to suit. Similarly, the LEDS can be made to flash on or off and to twinkle, if desired instead of being constantly on when the night-light rug 10 is activated. Custom shapes are also possible for the night-light rug 10. For example, it can include a shape that wraps around a toilet.

If desired, for certain embodiments of the night-light rug 10, the first predetermined period of time can be set to zero. In other words, the LEDS can be set to illuminate only when the night-light rug 10 is stepped on and to go off immediately when the user steps off of the night-light rug 10. Alternately, for certain embodiments of the night-light rug 10, the switch input 52 can be eliminated and a fixed magnitude for the first predetermined period of time can be included as part of its design (i.e., as part of the electronics 50).

For example, if the night-light rug 10 is used as an outside doormat a short duration of a minute may be preferred for the first predetermined period of time, whereas if it is used as a bedside mat for use in skilled nursing facilities or other areas where a longer "on-time" is preferred, the first predetermined period of time can be set to keep the LEDS illuminated for several minutes.

Also, any preferred material can be used to form the light panel 16. For example, closed or open cell types of foam can be used as well as any other material that is suitable.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A night-light rug, comprising:

(a) a light panel that includes a plurality of LEDS therein, at least one sensor or pressure activated switch, electronic means for controlling said plurality of LEDS, and at least one battery for supplying electrical energy to said electronic means and to said plurality of LEDS subsequent to an activation of said at least one sensor or pressure activated switch;

(b) a rug disposed over said light panel, said rug being sufficiently transparent to permit at least some illumination from said plurality of LEDS to pass through said rug when said plurality of LEDS are illuminated; and (c) wherein said electronic means and said plurality of LEDS are normally disposed in a quiescent state in which said plurality of LEDS are off, and wherein said electronic means energizes at least some of said plurality of LEDS for a first predetermined period of time after an initial activation of said at least one sensor or pressure activated switch and wherein said electronic means de-energizes all of said plurality of LEDS after said first predetermined period of time has elapsed.

2. The night-light rug of claim 1 wherein said at least one sensor or pressure activated switch includes a normally open type of switch.

3. The night-light rug of claim 1 wherein said at least one sensor or pressure activated switch includes a plurality of pressure activated switches.

4. The night-light rug of claim 3 wherein said plurality of pressure activated switches are disposed in said light panel and wherein an activating portion of each of said plurality of pressure activated switches extends above a plane that is defined by an upper planar surface of said light panel, and including a transparent plastic sheet that is placed over said light panel and under a portion of said rug, and wherein when a sufficient weight is placed on said portion of said rug said weight depresses said rug and said plastic sheet sufficient to activate at least one of said plurality of pressure activated switches.

5. The night-light rug of claim 1 including a transparent plastic sheet that is placed over said light panel and under a portion of said rug, and wherein when a sufficient weight is placed on said portion of said rug said weight depresses said rug and said plastic sheet sufficient to activate said at least one pressure activated switch.

6. The night-light rug of claim 1 wherein said quiescent state does not draw any electrical energy from said at least one battery.

7. The night-light rug of claim 1 wherein each of said plurality of LEDS is disposed in a recess.

8. The night-light rug of claim 7 wherein said recess includes a hemispherical shape.

9. The night-light rug of claim 7 wherein said recess includes a reflective material disposed therein, and wherein said reflective material reflects a greater amount of light energy out of said recess than would occur in the absence of said reflective material.

10. The night-light rug of claim 7 wherein each of said plurality of LEDS are disposed in said recess and below a plane that is defined by an upper planar surface of said light panel.

11. The night-light rug of claim 10 wherein each of said plurality of LEDS includes a longitudinal axis and wherein said longitudinal axis of each of said plurality of LEDS is horizontal.

12. The night-light rug of claim 1 wherein said rug includes a decorative design and wherein said plurality of LEDS are disposed in said light panel at predetermined locations that, when illuminated, augment the aesthetic appearance of said decorative design.

13. The night-light rug of claim 1 wherein said rug is detachably-attachable with respect to said light panel.

14. The night-light rug of claim 13 wherein said rug includes a pouch at a bottom thereof, and wherein said pouch is adapted to receive at least a portion of said light panel therein and to secure said light panel to said rug.

15. The night-light rug of claim 13 wherein said night-light rug includes means for maintaining said light panel in a predetermined position with respect to said rug, and wherein when said light panel is maintained in a desired position relative to said rug by said means for maintaining said light panel in a predetermined position with respect to said rug, any of said plurality of LEDS is disposed under a predetermined location of said rug and to provide a source of illumination that is disposed under said predetermined location of said rug when said any of said plurality of LEDS is energized.

16. The night-light rug of claim 1 wherein said electronics includes a first timer that is activated for said first predetermined period of time when said night-light rug is activated, and wherein said first timer is unaffected by any further activation of said night-light rug that occurs during said first predetermined period of time.

17. The night-light rug of claim 1 wherein said electronics includes a first timer that is activated for said first predetermined period of time when said night-light rug is activated, and including a second timer that is activated for a second period of time when said night-light rug is activated, and wherein said second period of time is shorter than said first period of time, and wherein said first timer is unaffected by any further activation of said night-light rug that occurs during said second predetermined period of time.

18. The night-light rug of claim 17 wherein said night-light rug is returned to said quiescent state subsequent to an activation of said night-light rug that occurs after said second predetermined period of time has elapsed and prior to an elapse of said first predetermined period of time.

19. The night-light rug of claim 1 wherein said electronics includes a switch input and wherein said switch input is adjustable by a user to control an operating parameter of said night-light rug.

* * * * *